United States Patent [19]

Scanlan et al.

[11] Patent Number: 4,521,674

[45] Date of Patent: Jun. 4, 1985

[54] ELECTRIC FLUID HEATER EMPLOYING PRESSURIZED HELIUM AS A HEAT TRANSFER MEDIUM

[76] Inventors: Harry J. Scanlan, 3 Cedar Pl., Garden City, N.Y. 11530; Leif Liljegren, 550 Ramapo Valley Rd., Oakland, N.J. 07436

[21] Appl. No.: 339,858

[22] Filed: Jan. 18, 1982

[51] Int. Cl.[3] ..... H05B 3/78; F24H 1/10; H01C 1/026

[52] U.S. Cl. ..... 219/299; 219/306; 219/308; 219/314; 219/325; 219/341; 219/365; 219/462; 219/530; 219/540; 313/578; 338/237

[58] Field of Search ..... 219/296, 299, 301, 303, 219/304, 306, 307, 314, 316, 318, 320, 321, 325, 326, 460–462, 530, 538, 540, 365–368, 378, 341, 342; 338/234–237; 313/222, 224, 569, 570, 578, 579, 643

[56] References Cited

U.S. PATENT DOCUMENTS

| | | | |
|---|---|---|---|
| 1,082,168 | 12/1913 | Philp et al. | 219/320 |
| 1,146,518 | 7/1915 | Quain | 338/237 |
| 1,401,510 | 12/1921 | Baumhauer et al. | 313/222 |
| 1,409,019 | 3/1922 | Parnell-Smith | 219/299 |
| 1,519,395 | 12/1924 | Clench | 219/299 |
| 1,557,682 | 10/1925 | Gazelle | 219/299 |
| 1,926,958 | 9/1933 | Peterson | 219/303 |
| 2,097,679 | 11/1937 | Swanson | 313/578 X |
| 2,196,484 | 4/1940 | Wentworth | 219/461 X |
| 2,207,558 | 7/1940 | Singer | 338/237 |
| 2,215,587 | 9/1940 | Kerschbaum | 338/237 |
| 2,227,294 | 12/1940 | Brody | 313/569 |
| 2,231,236 | 2/1941 | Wentworth | 219/538 X |
| 2,446,367 | 8/1948 | Graves | 219/314 |
| 2,894,166 | 7/1959 | Mohn | 313/578 |
| 3,246,634 | 4/1966 | Stevens . | |

*Primary Examiner*—A. Bartis

*Attorney, Agent, or Firm*—Brumbaugh, Graves, Donohue & Raymond

[57] ABSTRACT

An electric fluid heating apparatus includes a closed hollow metallic vessel filled with substantially pure gaseous helium at a pressure from about 30 psl absolute to about 100 psl absolute. At least one electric resistance heating element is disposed in the vessel and surrounded by the pressurized helium which acts as a heat transfer medium to conduct heat from the resistance element to the vessel walls by conduction and convection. The vessel is positioned within a closed container having walls spaced from the vessel to define a fluid flow path for the fluid to be heated. A baffle between the container and vessel divides the flow path into an inlet chamber in which the fluid entering the flow path is preheated and an outlet chamber in which the fluid is heated by contact with the vessel walls prior to discharge from the container through a metal outlet conduit passing through the vessel in contact with the helium for transfer of additional heat to the fluid.

7 Claims, 1 Drawing Figure

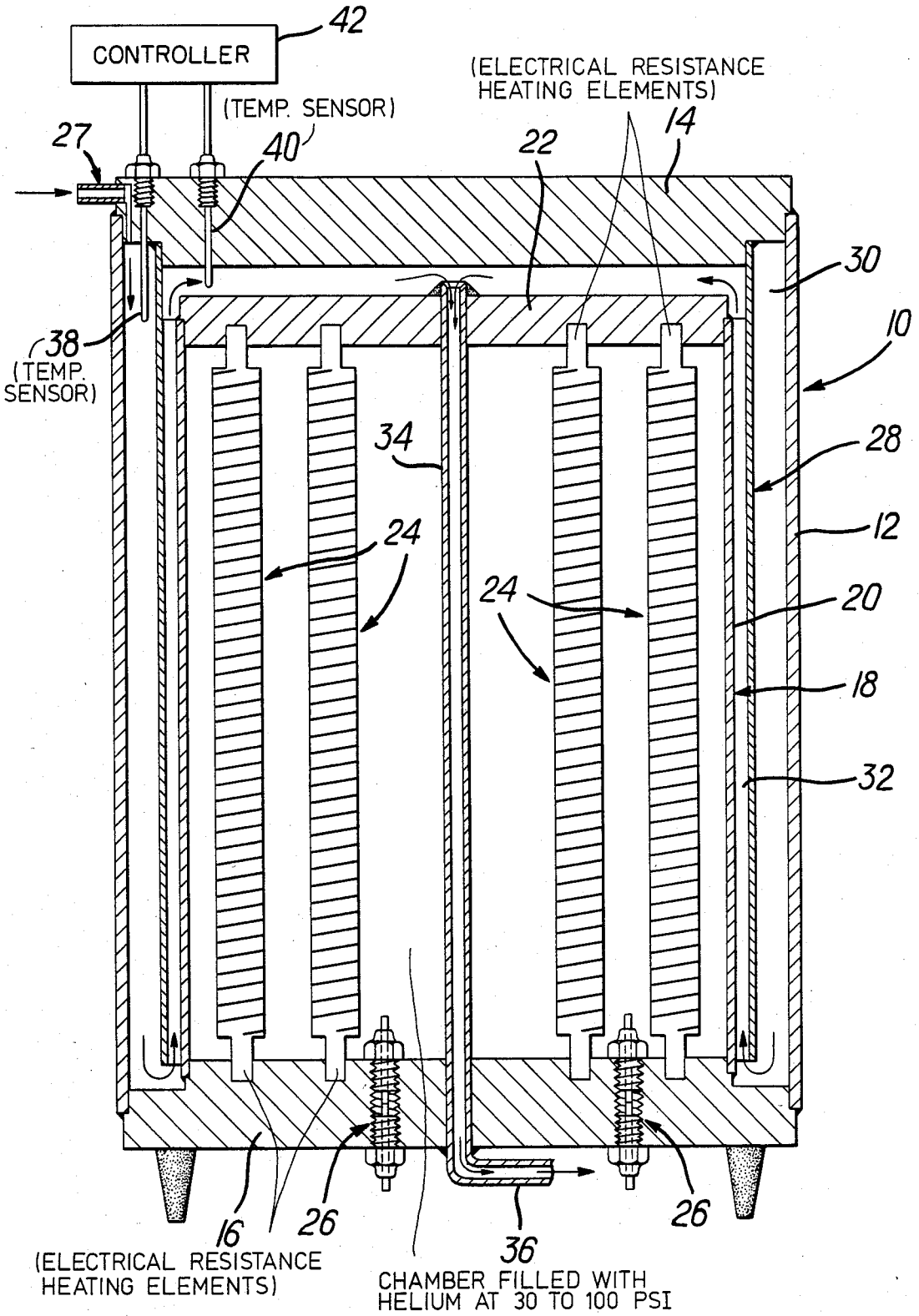
CONTROLLER
42
(TEMP. SENSOR)
40
27
(ELECTRICAL RESISTANCE HEATING ELEMENTS)
14
22
30
10
38
(TEMP. SENSOR)
34
28
12
24
24
20
18
32
16
26
26
36
(ELECTRICAL RESISTANCE HEATING ELEMENTS)
CHAMBER FILLED WITH HELIUM AT 30 TO 100 PSI

ELECTRIC FLUID HEATER EMPLOYING PRESSURIZED HELIUM AS A HEAT TRANSFER MEDIUM

FIELD OF THE INVENTION

The present invention relates to the heating of fluids with electrical energy and, in particular, to a small, inexpensive, durable heater for heating fluids, (liquids or gases) efficiently and rapidly.

BACKGROUND OF THE INVENTION

Electric heaters for heating fluids have the advantages of being easy to install, because they require no exhaust for burned gases, clean, because there is no burned gas exhausted from a burner, and convenient, because electric current is readily available without the refilling required for propane and oil. Electric heaters do not require cleaning of burners and exhaust ducts and do not need the fairly expensive types of safety shut-offs of gas and oil fueled equipment.

Most electric heaters for liquids have electrical resistance heating elements that are suitably housed, usually in copper or aluminum tubes, and electrically insulated from and mechanically supported within the tubes by ceramic cores. This type of heating element is simply immersed in a vessel through which the liquid to be heated is passed. Some heaters for liquids use exposed electrodes that impress a voltage across the liquid, in which case the liquid itself is a resistance and is heated by the current passing through it.

Immersible electrical resistance heating elements are relatively costly to make and are subject to corrosion and to accummulation of deposits from the fluid due to direct contact with the fluid being heated. They also provide, individually, only a small surface area for heat transfer to the fluid. For rapid heating of a fluid a cluster of many elements is needed in order to provide a large heat transfer area. Baffles are often provided to direct the fluid flow back and forth across the cluster to enhance heat transfer. So-called "instantaneous" heaters, in which there is very little storage capacity, have very costly immersible heating units made up of many U-shaped elements or long coil elements and baffles.

There are various types of electric space heaters. For example, there are the radiant types in which the resistance elements are suitably mechanically supported in an open frame in front of a reflector and are physically protected, often inadequately, by a grid in front. A blower may be provided to induce heat transfer to the space by convection. Recently, heaters having resistance elements carried in transparent tubes have become popular. Many of the electric space heaters currently on the market are hazardous, because foreign objects can get close enough to a hot surface to ignite the object. Also, someone who accidentally touches certain parts of the housing can receive a painful burn.

SUMMARY OF THE INVENTION

There is provided, in accordance with the present invention, a heater that is small, inexpensive and durable and heats fluids (liquids or gases) efficiently and very rapidly. In particular the heater comprises a closed vessel containing gaseous helium and at least one electrical resistance heating element in the vessel. In the case of space heaters, the walls of the vessel become hot and transfer heat directly to the space by radiation, conduction, and convection. A blower can be added, if desired, to increase heat transfer by convection.

For heating gases other than air or liquids, the gas or liquid is conducted through at least one passage that has a wall that is in contact with the helium in the vessel. That passage of the heater may be a bank of tubes that extend into or through the helium-containing vessel or the passage may be defined by a closed container surrounding the helium-containing vessel, in which case the wall of the passage that is in contact with the helium in the vessel is, in fact, defined in part by the wall of the vessel itself, the passage being further defined by the wall of the container that receives the vessel.

In one embodiment of the invention, the vessel is received within a closed container, and a baffle is interposed between the container and the vessel to define an inlet chamber in which the fluid entering the vessel flows in contact with the container walls and the baffle and an outlet chamber in which the fluid flows in contact with the baffle and the vessel walls. The incoming fluid is at a relatively low temperature, thereby minimizing loss of heat through the wall of the container, and the fluid in the outlet chamber is rapidly heated but nonetheless loses comparatively little heat because it is insulated from the outside by the inlet chamber. Whatever heat is transferred across the baffle from the outlet chamber to the inlet chamber goes primarily to heating the fluid in the inlet chamber. In this preferred embodiment the heated fluid may be drawn directly from the outlet chamber, or it may be conducted through a passage that extends into or through the vessel, such as a straight pipe extending the length of the vessel, a U-shaped tube extending into the vessel, or a coiled pipe passing through the vessel. The gas pressure in the vessel is preferably in the range of from about 30 to about 100 psi absolute. It is desirable, though not essential, that the vessel be evacuated before being filled with helium, in which case the gas present in the vessel consists essentially of helium.

Among the advantages of the invention are the following:

1. Relatively inexpensive heating elements can be used, as compared to the immersible types used in prior art heaters. A ceramic insulator wound with resistance wire and suitably supported within the vessel is appropriate.

2. The heating elements are contained in an essentially inert environment where they are not subject to corrosion, to the build-up of deposits and to possible erosion from fluid passing over them. Accordingly, they will have a long and trouble-free life.

3. The atmosphere of helium gas provides a large heat transfer area which makes it easy to obtain the desired heat transfer between the hot helium gas and the fluid. This is particularly so in the case of a heater in which the heating passage for the fluid surrounds and is defined partly by the walls of the helium-containing vessel.

4. Helium has, among all gases, an extremely high coefficient of thermal conductivity. Accordingly, heat generated by the resistance heating elements in the vessel is transferred very rapidly to the walls of the vessel and to the walls of any fluid passages that extend into or through the vessel. The rapid rate of heat transfer from the heating elements through the gas and to the walls of passages for the fluid makes the heater well suited for instantaneous type heaters.

5. As compared to large bundles of sheathed and insulated rods of the type used for immersible heating elements, often with many baffles, bus bars, insulators, and the like, the heating unit of a heater, according to the present invention, is much lighter in weight, more easily manufactured and considerably less costly. In the long run it is probably desirable to manufacture the heating unit (i.e., the helium-containing vessel with heating elements) as a permanent unit not subject to dismantling and replacement of individual components. Instead the entire unit can be removed from the container of the heater and replaced as a unit. This is made possible because of the comparatively low cost of the heating unit, as compared to the high cost of immersible electric rods and coils.

6. In the case of a space heater in which heat is transferred directly to the ambient air from the walls of the helium-containing vessel, the vessel walls provide a large surface area to receive the heat output of the elements while not becoming excessively hot. The heat received by the walls is transferred to the environment rapidly enough to maintain the walls at a comparatively low, safe temperature. The walls are, preferably, aluminum for light weight and high thermal conductivity and can be thick enough to make the unit very durable. Corrugated walls may be desirable for maximizing surface area and strength while keeping the overall size low. A small fan can be installed under the vessel to increase the rate of heat transfer from the vessel to the ambient air.

The invention has numerous uses. One important field of use is in hot water heating for individual residences, apartments, hotels, motels and office and institutional buildings. Because the heater is so economical and easy to install without the need for any venting, comparatively small units can be placed around a building in proximity to the facilities which they serve; for example, in a motel or hotel individual heaters may serve just a few rooms. This concept provides savings in capital investment and operating costs by eliminating costly, long hot water distribution systems and the heat losses that occur in such distribution systems. The water heaters can be used for heating process gases and liquids in industrial processes and for heating water for swimming pools. Where relatively inexpensive electricity is available, hot water heated in a water heater may be used for space heating by conducting it to heat exchangers throughout the space to be heated. Because the space heaters embodying the invention are inexpensive, safe, and durable, they are well suited to provide temporary booster heat or primary heat in all types of space.

For a better understanding of the invention, reference may be made of the following description of an exemplary embodiment, taken in conjunction with the accompanying drawing.

DESCRIPTION OF THE DRAWING

The single FIGURE of the drawing is a side-cross-sectional view of an instantaneous type water heater.

DESCRIPTION OF THE EXEMPLARY EMBODIMENT

The water heater comprises an outer container 10 having a circular cylindrical side wall 12, a top wall 14 and a bottom wall 16. A closed vessel 18, which consists of a circular cylindrical side wall 20, a top wall 22 and the bottom wall 16 of the container, receives any suitable number of electrical resistance heating elements 24. Each heating element comprises a ceramic support and a helical winding of conventional nichrome wire. Preferably, the wires of the heating elements 24 are connected in series by a system of bus-bars (not shown), and suitable electrical connectors 26 conduct electric current to the first element and from the last element in the series. The use of heating elements connected in series enables heavier gage nichrome wire to be used, thereby ensuring long life, but parallel wired elements and the possibility of having two or more groups of series wired elements, with the groups wired in parallel is, of course, entirely feasible. Parallel wired electrical heating elements present the possibility of providing variable heat output by varying the number of elements that are switched on at any point in time in response to suitable controls.

It is considered preferable for the container 10 and vessel 18 to be entirely of welded construction for assurance against leakage, and this is the case with the embodiment shown in the drawing. It is, nonetheless, envisioned that the heating unit (i.e., the vessel 18 with electrical heating elements 24) can be constructed so that it can be removed from the container 10. There are various ways that will be readily apparent to those skilled in the art as a matter of ordinary engineering skill of making the heating unit removable. For some types of service, notably those in which deposits build up within the container because of the characteristics of the fluid, the ability to remove the heating unit from the container may also be desirable in order to provide access to the container for thorough cleaning from time to time. For service with liquids, it will usually be desirable to provide a valved drain outlet (not shown) in the bottom of the container.

Fluid to be heated is supplied to the container 10 through an inlet 27 in the top adjacent the outer wall 12. A manifold distribution system (not shown) may be interposed between the inlet and the annular space between the side wall 12 of the container and the side wall 20 of the vessel, or multiple inlets can be provided to distribute the incoming fluid relatively evenly around the upper part of the container. The annular space between the walls 12 and 20 is subdivided by a circular cyclindrical baffle 28 that extends nearly the entire distance from the top wall 14, to which it is welded, to the bottom wall 16 of the container into an inlet chamber 30 and an outlet chamber 32. The fluid entering the inlet 27 is compelled by the baffle 28 to flow down through the inlet chamber to the bottom of the container and then turn and flow upwardly through the outlet chamber to the top of the container. The then heated fluid flows radially inwardly toward the axis of the container and enters a outlet pipe that extends vertically through the vessel 18 and exits through the bottom wall 16 of the container to an outlet 36.

The vessel 18 contains helium gas at a suitable pressure, preferably in the range of from about 30 psia (pounds per square inch absolute) to about 100 psia. The vessel 18 may be, but need not be, evacuated before being charged with helium. The thermal conductivity of helium is the second highest of all gases—only hydrogen has a higher coefficient—and is about five times that of air. Accordingly, the helium atmosphere within the vessel provides an excellent medium for rapid transfer of heat from the electrical resistance heating elements 24 in the vessel to the walls of the vessel 18 and the pipe 34.

As the fluid entering the inlet 27 flows down through the inlet chamber 30 between the baffle 28 and the wall 12 of the container it is gradually preheated, inasmuch as the fluid flowing up through outlet chamber 32 flows in direct contact with the hot walls of the hot outer wall 20 of the vessel and transfers some of the heat it receives from the vessel wall out to the baffle which, in turn, transfers it to the fluid flowing through the inlet chamber. The fluid flowing up along the hot outer wall 20 of the vessel is rapidly heated in the relatively thin channel defined between the wall 20 and the baffle 28. The wall 20 provides a very large surface area to which heat is transferred from a suitable number of heating elements 24 within the vessel very rapidly by the helium atmosphere. Thus, the heater is ideally suited for substantially instantaneous heating of a fluid. Heat losses from the heater are kept to a minimum, because the incoming fluid provides an insulating barrier. Inasmuch as heat transfer is a function of the difference in the temperatures on opposite sides of a barrier, the loss of heat through the outer wall 12 is kept low because the incoming fluid is only slightly heated, as compared to the much higher temperature of the fluid flowing through the outlet chamber. This natural barrier of the incoming fluid in the chamber 30 contributes to the high efficiency of the unit.

It is preferable for the outlet chamber to be very thin in order to promote turbulant flow of the fluid, and the turbulence and the surface area may be increased by providing a corrugated outer wall on the vessel, or by providing fins or other devices for promoting turbulence.

Upon reaching the top of the outlet chamber 32 the fluid flows inwardly across the top of the vessel, where it receives additional heat, and then passes through the outlet pipe 34, again receiving heat from the wall of the pipe to which heat is rapidly and effectively transferred by the helium atmosphere within the vessel.

The heating elements 24 may be controlled by any suitable thermostatic control system, preferably one which measures temperature of the incoming fluid near the inlet by means of a thermacouple 38, measures the temperature of the fluid after it has been substantially heated, such as by a thermocouple 40, and turns the elements 24 on and off in accordance with some integrated value that takes into account both incoming and outgoing temperatures. Many such systems are known in the art and are shown schematically in the drawing by means of the block 42 labelled "controller." The ability of the helium atmosphere within the vessel to transfer heat rapidly to the walls along which the fluid passes and by which the fluid is heated improves the response rate of the control system.

The embodiment illustrated in the drawing is an instantaneous type unit, inasmuch as it has virtually no storage capacity. It can be controlled to maintain the temperature of the fluid in the region of the thermocouple 40 somewhat heated but not heated to the output temperature. When fluid is demanded from the outlet 36, the thermocouple 38 detects a drop in temperature and the controller 42 switches on the heating elements 24. In a matter of a few seconds the helium atmosphere within the vessel begins transferring heat from the heating elements to the wall 20 and the pipe 34, and the fluid flowing from the outlet becomes rapidly hotter until it attains a desired temperature. The heating element is then controlled primarily by the thermocouple 40 to cycle the heating elements on and off and maintain a fairly constant temperature of the fluid coming from the outlet 36. When fluid is no longer drawn from the heater, the thermocouple 38 will detect an increase in temperature indicative of the fact that cold fluid is no longer entering through the inlet 26, in such indication is processed in the controller 42 and shuts off the heating elements.

The invention is applicable to storage type liquid heating equipment, which equipment may incorporate designs known in the prior art insofar as temperature control, possible recycling of fluid from the container through the heater and similar design factors. The heater shown in the drawing is well-suited for heating process gases, as is a unit having pipes or ducts that pass through the space within the vessel. The vessel 28 itself (without the outer container 10) is an excellent space heater. The wall area and heat output of the heating elements 24 are chosen to keep the walls moderately hot, but not so hot as to be hazardous. Suitable thermostatic controls can be provided to prevent overheating. The side wall may be corrugated in the longitudinal direction for greater strength and surface area for a given overall size and weight. Other variations and modifications of the invention will readily be apparent to those skilled in the art without departing from the spirit and scope of the invention. All such variations and modifications are intended to be included within the scope of the invention as defined in the appended claims.

We claim:

1. A fluid heater comprising a closed metal vessel containing substantially pure gaseous helium at a pressure of from about 30 psi absolute to about 100 psi absolute and at least one electrical resistance heating element in the vessel, the vessel having thermally-conducting walls in contact with the helium in the vessel for transfer of heat from the helium to the walls and thence to a fluid outside the walls, the helium being a medium for rapid transfer of heat from the heating element by conduction and convection to the vessel walls.

2. A heater according to claim 1 wherein the closed helium-containing vessel is received within a container having an inlet for receiving the fluid to be heated from a supply and an outlet for discharging the fluid spaced-apart from the inlet, whereby the fluid passes adjacent the walls of the vessel in flowing between the inlet and outlet and receives heat from the vessel walls.

3. A heater according to claim 1 or claim 2 and further comprising at leat one metal conduit passing through the vessel and having an inlet at one end for receiving a liquid to be heated from a supply and an outlet at the other end for discharging the liquid therefrom, whereby liquid passing therethrough receives heat from the conduit walls.

4. A heater according to claim 2 and further comprising a baffle between the container and the vessel defining an inlet chamber in which the fluid entering the container flows in contact with the container walls and an outlet chamber in which the fluid flows in contact with the vessel walls and wherein the inlet communicates with the inlet chamber and the outlet communicates with the outlet chamber.

5. A heater according to claim 4 and further comprising a metal outlet conduit leading at one end from the outlet chamber and passing through the vessel in contact with the helium for transfer of additional heat to the fluid as it passes through, and wherein the outlet leads from the other end of the outlet conduit.

6. A fluid heater comprising a container having end walls and side walls, a closed metal vessel within the container having side walls spaced apart from the side walls of the container, substantially pure gaseous helium contained in the vessel at a pressure of from about 30 psi absolute to about 100 psi absolute, at least one electrical resistance heating element within the vessel in contact with the helium, the helium being a medium for transferring heat from the heat element to the vessel walls by conduction and convection, a baffle extending from one end wall of the container and substantially the entire length along the container to the other end wall and defining a fluid inlet chamber with the side walls of the container and a fluid outlet chamber with the side walls of the container and a fluid outlet chamber with the side walls of the vessel, a fluid inlet to the inlet chamber proximate to said one end wall and a fluid outlet from the outlet chamber proximate to the other end wall whereby fluid to be heated enters the outlet chamber and is constrained by the baffle to flow substantially the entire length of the container through the inlet chamber for preheating and then back along substantially the entire length of the vessel for heating by the walls of the vessel.

7. A heater according to claim 6 and further comprising a fluid outlet passage connected to the outlet of the outlet chamber and passing through the vessel for additional heating of the fluid.

* * * * *